US006347902B1

(12) United States Patent
Loh

(10) Patent No.: US 6,347,902 B1
(45) Date of Patent: Feb. 19, 2002

(54) LINEAR CONNECTOR OF PLASTIC MATERIAL OF JOINING SPACING PROFILES OF MULTIPLE INSULATING GLASSES

(75) Inventor: Walter Loh, Kaufbeuren-Neugablonz (DE)

(73) Assignee: CERA Handelsgesellschaft mbH (DE)

( * ) Notice: Subject to any disclaimer, the term of this patent is extended or adjusted under 35 U.S.C. 154(b) by 0 days.

(21) Appl. No.: 09/532,291

(22) Filed: Mar. 23, 2000

(30) Foreign Application Priority Data

Aug. 10, 1999 (DE) ..... 299 13 899 U
Aug. 10, 1999 (DE) ..... 299 13 903 U

(51) Int. Cl.[7] ..... E06B 3/66
(52) U.S. Cl. ..... 403/298; 428/122; 403/292
(58) Field of Search ..... 428/122; 403/298, 403/292

(56) References Cited

U.S. PATENT DOCUMENTS 5,603,582 A * 2/1997 Loh ..... 403/298

* cited by examiner

*Primary Examiner*—Alexander S. Thomas

(74) *Attorney, Agent, or Firm*—Gifford, Krass, Groh, Sprinkle, Anderson & Citkowski, P.C.

(57) ABSTRACT

The invention concerns a linear connector of plastic material for joining hollow spacing profiles of multiple insulating glasses comprising a longitudinal body having a complete or essentially complete U-configured cross-section for the passage of a hygroscopic powder and being insertable into the hollow space of the one spacing profile as well as the hollow space of the other spacing profile of the two profile bodies to be joined. The surface of the linear connector is provided with abutment elements which are pushed against the opposing front faces of the profile bodies upon the insertion of the linear connector into the profile bodies. Moreover, the surface of the linear connector is provided with blade-like springs in order to create a strong seat between the body and the inner wall of the spacing profiles.

In order to avoid deformation already upon the insertion of the linear connector into the hollow space of the spacing profiles on the connector resulting in an essential decrease of the frictional forces developed between its surface and the inner wall of the spacing profile opposite thereto and thus affecting negatively the required strong seat, it is proposed to configure the linear connector such that the blade-like springs extending from the lateral surfaces of the two legs of the U-profile body outwardly are connected by thin bars and that the two parallel legs of the U-profile body are provided on its inner wall with anchoring ribs supported by the bottom plate of the U-profile body.

21 Claims, 2 Drawing Sheets

LINEAR CONNECTOR OF PLASTIC MATERIAL OF JOINING SPACING PROFILES OF MULTIPLE INSULATING GLASSES

DESCRIPTION OF THE PRIOR ART

The invention concerns a linear connector of plastic material for joining hollow spacing profiles of multiple insulating glasses, comprising a longitudinal body having a completely or nearly completely U-configured cross-section for the passage of a hygroscopic substance in form of a powder within this cross-section. This linear connector is to be inserted into the hollow space of one spacing profile as well as the hollow space of the other spacing profile of the two profile bodies which are to be joined. For that purpose the surface of the linear connector is provided with abutment elements abutting the front faces of the profile bodies opposite to one another upon the insertion of the linear connector as well as with blade-like springs effecting a strong seat of the longitudinal body of the linear connector within the spacing profiles. Known linear connectors of that kind are disclosed by German Utility Models 8,816,799 and 9,216,955. These linear connectors, however, do not operate satisfyingly with respect to the retaining force they are developing in order to hold the spacing profiles together after the linear connector has been mounted. Thus, it often happens that the connecting gap of the profile bodies after mounting the linear connector opens again, particularly in case the profile bodies are comprised of steel. Through such a gap the hygroscopic powder located in the hollow space of the profile body can enter the space between the glass panes polluting the same.

In this connection it must be pointed out that a double running longitudinal linear connector is already known used for the connection of two parallel hollow spacing profiles of a multiple insulating glass separated by an insulating element, which insulating glass is provided with at least two parallel glass panes separated at their surrounding edge by a spacing profile as shown by U.S. Pat. No. 5,603,582.

The essential precondition for retaining together the distant profiles at the connecting gap is the requirement that the U-profile body of the longitudinal connector will be essentially elastically and not plastically deformed upon mounting in the hollow space of the spacing profiles to be joined so that its elasticity is maintained and those portions of the surface of the linear connector contacting the inner wall of the spacing profiles create a frictional force which is maintained over long times, at least, up to the time the insulating glass panes are fixed at the spacing profile body, which means, the frame comprising the corresponding spacing profiles has been mounted between the two glass panes and has been sealed.

SUMMARY OF THE INVENTION

The object underlying the invention is therefore to provide a linear connector of the above mentioned kind avoiding the mentioned drawbacks and being configured such that its deformation caused by the mounting in the hollow space of the spacing profiles does not essentially reduce the frictional forces between its surface and the adjacent inner wall of the spacing profiles.

It is a further object of the invention to improve the linear connector so that its deformation should not be of plastic nature but of elastic nature. This means, on mounting the elasticity of the blade-like configuration of its body should be maintained after its mounting at least some time.

According to a further object of the invention, the linear connector should have a strong seat after its mounting in the hollow space of the spacing profiles so that the gap between the front faces of the spacing profiles does not open but remains closed.

These and other objects of the invention will be advantageously solved by a construction, which is characterized in that the blade-like spring extending from the lateral surfaces of the two legs of the U-profile body outwardly are joined by thin bars, and that the two parallel legs of the U-profile body are provided on its inner wall with anchoring nbs supported by the bottom of the U-profile body.

The connection of the blade-like springs by thin bars has the advantage that the springs are supported upon the insertion of the linear connector into the hollow spacing profiles so that they cannot tilt and will not be plastically deformed what is the reason why the elastic spring effect and thus the frictional force between the U-profile body and the spacing profile is maintained. This has the consequence that the connecting gap between the two spacing profile bodies which are to be joined will be maintained closed at least so long as the spacing profile is permanently connected to the glass panes by the isolating material surrounding the edges of the multiple isolating glass. Because after mounting the gap between the spacing profile bodies does not open no hygroscopic powder can enter the space between the glass panes and thus no pollution of the glass panes occur. Moreover, the use of the reinforcing nibs as a support for the legs of the U-profile body against its bottom is advantageous because these reinforcing nbs avoid deformation of the legs, if bending forces are introduced in direction to the longitudinal axis of the body. Thus, it is possible to further reduce the thickness of the wall of the legs, in order to save plastic material. As a consequence thereof an increase of elasticity of the legs under influence of deformation forces as well as an increased cross-section for the passage of the hygroscropic powder are achieved.

In this connection it is also particularly advantageous to extend the bars connecting the blade-like springs which extend from the lateral surfaces of the two legs of the U-profile body outwardly, parallel to the longitudinal axis of the U-profile body and moreover to arrange these bars aligned in a row behind one another providing these bars with the same dimensions. Moreover, the bars should advantageously extend to the tips of the blade-like springs and should have a skin-like configuration in order to enforce the elastical repulsion forces of the springs upon the insertion of the linear connector into the hollow space of the spacing profiles.

According to a further advantageous feature of the invention the succeeding springs are connected by several parallel bars which are dimensioned or configured, respectively, such that they counteract the bending forces affecting the springs upon the insertion of the linear connector into the hollow space of the spacing profiles, thus avoiding that the springs are tilted.

Further advantageous embodiments, arrangements and configurations of the bars are characterized therein that the bars are with respect to the width of the springs arranged offset to one another or in addition to that with respect to the bottom of the U-profile body filling completely in such an arrangement the free space between the springs following up to one another.

With respect to the two parallel legs of the U-profile body which are provided on their inner wall with reinforcing ribs being supported on the bottom of the U-profile body, it is also advantageous to provide each leg with at least two reinforcing ribs positioned symmetrically to the center axis of the U-profile body and forming with the bottom of the inner wall of the legs an equilateral triangle.

In order to optimize the support of the legs the reinforcing ribs should extend up to about the half height of the legs, and the reinforcing ribs should have the same dimensions and should be equally distributed over the surface of the U-profile body. In order to optimize the passage of the hygroscropic powder through the hollow space of the spacing profiles as well as through the linear connector, it is advantageous to provide the reinforcing ribs with inclined or rounded front sides and back sides, in order to minimize in such a way the flow resistance of these ribs with respect to the hygroscopic powder passing through.

DESCRIPTION OF THE DRAWINGS

The invention will be described in the following on the basis of the drawings in detail in which.

DESCRIPTION OF THE PREFERRED EMBODIMENTS

Figure 1:
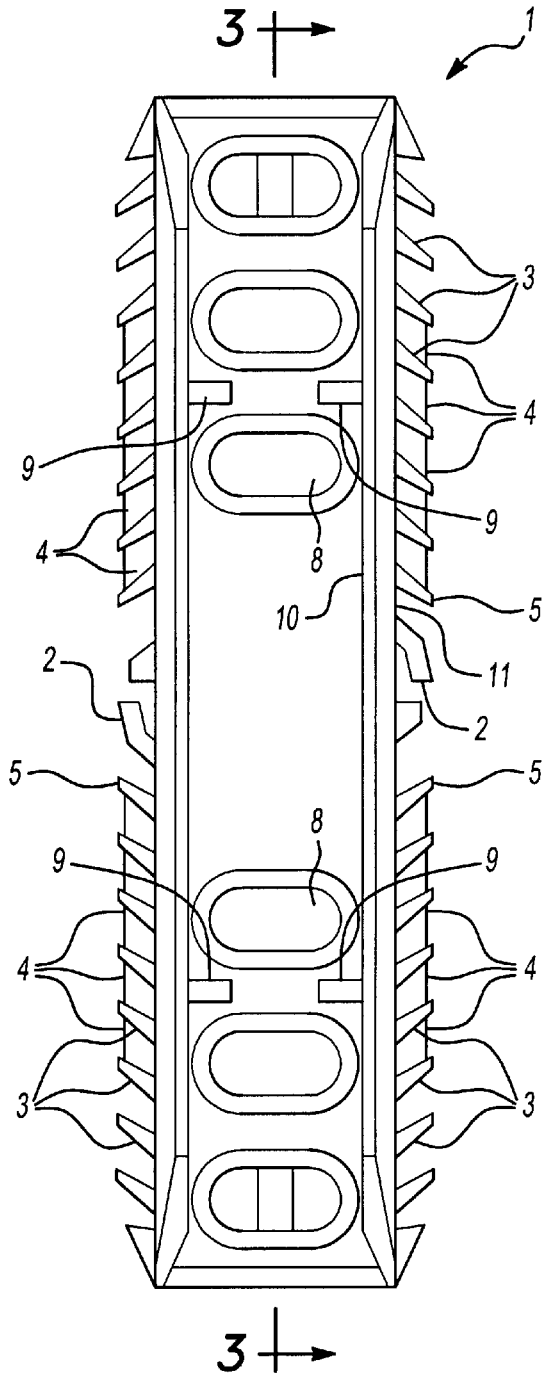
FIG. 1 is a schematical plan view of the linear connector.
Figure 2:
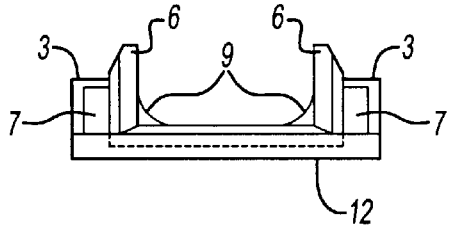
FIG. 2 is a front view of the linear connector of FIG. 1.
Figure 4:
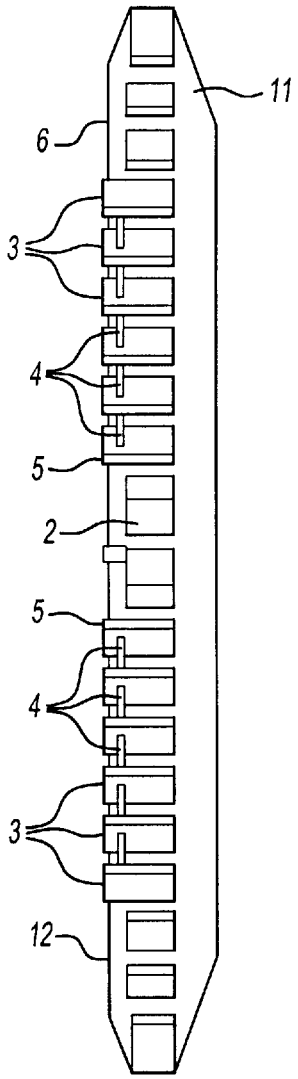
FIG. 4 is a lateral view of the linear connector of FIG. 1 in the direction of the arrow D.

The linear connector shown in FIG. 1 is an U-profile body 1 of plastic material and is thus provided with an essentially complete U-configured cross-section. It is used to join the hollow spacing profiles of multiple insulating glasses. For that purposes its cross-section is adapted to the profile bodies which are to be joined and is guided within their ends up to an abutment 2. The U-profile body 1 comprises two parallel legs 6 standing on the bottom plate 12 of the profile body as shown in FIG. 2 and being reinforced by reinforcing ribs 9. From the lateral surfaces 11 of the two legs 6 blade-like springs 3 extend outwardly which are partly joined by thin bars 4 extending parallel to the longitudinal axis A of the U-profile body and arranged as shown in FIG. 4 in line one behind the other. Upon the insertion of the linear connector into the spacing profiles the springs 3 come elastically in contact with the inner wall of the spacing profiles and thus cause a friction avoiding that the closed gap at the front sides of the profile bodies of the joined spacing profiles, not shown in the drawings, is opening lateron. The bars 4 are located as also shown in FIG. 4 with respect to the width of the springs 3 adjacent to the center, what means that they are moved against the bottom plate 12 of the U-profile body 1. These bars extend to the tips 5 of the blade-like springs and are provided with a skin-like element reinforcing the elastic repulsion force of the springs upon the insertion of the linear connector into the hollow space of the spacing profiles. In any case the bars are configured such that upon the insertion of the linear connector they counteract the bending forces and pressure forces affecting the springs, thus avoiding that the springs are tilted.

The insertion of the linear connector happens up to the abutments 2 on the lateral surfaces 11 of the two legs 6 of the U-profile body 1 and thus up to the center of the connector. The insertion procedure is supported by the wedge-like elements 7 at both ends of the U-profile body as well as by the fact that the springs are at these ends shorter than in the remaining area in which they are joined by the bars 4.

Moreover, the bottom plate 12 of the U-profile body 1 is provided with apertures 8 which, however, have nearly nothing to do with the arrangement and configuration of the springs but are used for saving plastic material without reducing the stability of the linear connector. In each case the cross-section of the linear connector is adapted to the crosssection of the spacing profiles which are to be joined. Arrangement and configuration of the bars 4 are variable in order to adapt them to the respective configuration of the profiles as well as to the blade-like springs 3. In this connection it should be realized that it would also be possible, but not shown in the drawings, to join the succeeding springs 3 by several parallel bars 4, if necessary.

Upon the mounting of the U-profile body within the hollow space of the spacing profiles the tips 5 of the springs 3 will be bent against the direction of insertion, because the U-profile body 1 is with respect to size of the hollow space related to the width of the U-profile body measured over the springs 3, dimensionally greater. Thus, the front face of the spacing profiles at first abut the tips 5. Although the springs 3 are pushed away or to the rear they are only elastically deformed and not plastically or permanently, because the skin-like bars 4 avoid a too strong deformation of the springs 3 by being themselves a little bit elastically pressed together in order to expend there after overcoming the insertion resistance caused by the front face of the spacing profiles. By doing so the blade-like springs retain their upright position and thus also the contact with the inner wall of the spacing profiles under frictional forces. This is the reason why the requested strong seat of the profile body within the spacing profiles is maintained and the gap between the spacing profiles does not open at least up to the finishing of the isolating glass pane, which means up to the connection of the frame consisting of the spacing profiles which are to be joined, and the two glass panes covering this frame.

In general, the above mentioned gap remains closed, because the bars 4 which are completely or at least nearly completely filing the free space between the springs 3 supplement permanently the frictional forces between the linear connector and the spacing profiles.

Figure 3:
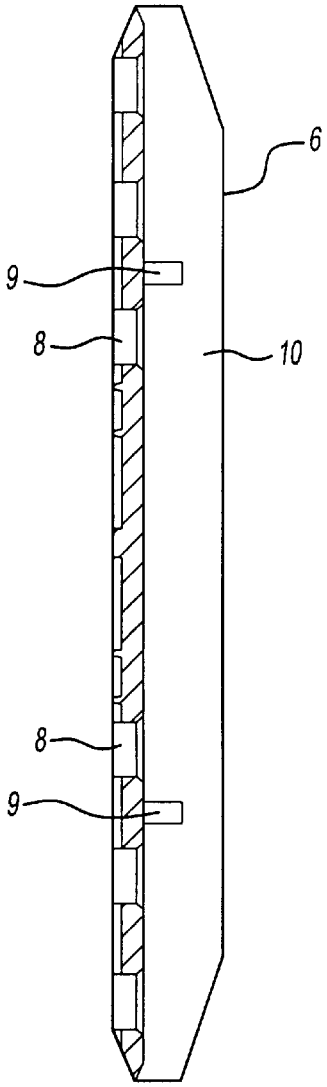
FIG. 3 is a longitudinal sectional view of the linear connector along the line B—B in FIG. 1.

As shown in FIGS. 1 and 3, each leg 6 of the U-profile body is provided with two reinforcing ribs 9 which are positioned symmetrically to the center axis C of the body and form with the bottom plate 12 of the U-profile body as well as with the inner wall 10 of its legs 6 preferably an isosceles, rectangular triangle, the hypothenuse thereof extending preferably up to the half height of the legs 6, which legs form with the inner wall 10 a rectangular angle.

It goes without saying that each leg 6 of the U-profile body could be provided with more than two of those reinforcing ribs. The front sides and back sides 13, 14 of those nbs could be inclined or rounded, respectively, in order to deminish the resistance of flow for the hygroscopic powder passing through, not shown in the drawings.

Moreover, it is possible to use at each leg instead of several only one reinforcing rib 9 extending essentially over the entire length of the U-profile body in order to optimize the support and simultaneously the flow resistance against the passage of the hygroscopic powder if compared with a multiplicity of ribs. Furthermore, those ribs could not only be provided with inclined or rounded front sides and back sides but could also be configured in general aerodynamically in order to further deminish the above mentioned resistance.

Both kind of reinforcing nibs have the advantage to push the bar 6 of the U-profile body upon the insertion of this body into the spacing profiles not too strongly inwardly so that a permanent deformation of the legs is avoided. The reinforcing nibs 9 resist such a deformation and they support by doing so the elastic reaction of the linear connector in cross-direction. These nbs are in this connection insofar advantageous as the thickness of the legs 6 can be reduced without demishing the stability of the U-profile body. This is resulting in an improvement of the elastic deformation in cross-direction of the linear connector and thus in an improvement of its strong seat within the hollow spacing profile body. A reduced wall thickness of the leg 6 has moreover the consequence that the free cross-section of the U-profile body is increased for the passage of the hygroscopic powder so that the fluid resistance possibly caused by the reinforcing ribs is nearly balanced.

What is claimed is:

1. A connector for joining hollow spacing profiles of insulating glass, said connector comprising:

a longitudinal body adapted for insertion into said spacing profiles, said body having a bottom plate and a pair of legs extending upwardly from said bottom plate, at least one rib deposed on said bottom plate, at least one abutment element secured to one of a lateral surface of one of said pair of legs and adapted to contact a front face of a profile body upon insertion of said body into said profile;

at least two springs extending outwardly from said lateral surface of at least one of said pair of legs; and a bar extending between and joining said springs;

whereby upon insertion of said body into said profile, the blade-like springs create a strong seat between said body and said spacing profiles and said bar counteracts the bending forces and pressure forces affecting the springs.

2. The connector of claim 1, comprising at least two bars and at least three springs, each of said bars joining a pair of said springs.

3. The connector according to claim 2, characterized in that each bar is positioned in line behind one another.

4. The connector according to claim 2, characterized in that each bar is of equal dimension.

5. The connector according to claim 2, characterized in that each bar extends up to a tip of each of the springs.

6. The connector according to claim 2, characterized in that each bar is provided with a skin-like element, said skin-like element reinforcing the elastic repulsion force of the springs upon the insertion of the connector into a hollow space of the spacing profiles.

7. The connector according to claim 2, characterized in that only some of the springs are connected by a bar.

8. The connector according to claim 2, characterized in that succeeding springs are connected to one another by at least two parallel bars.

9. The connector according to claim 2, characterized in that each bar is dimensioned and configured such that the bar counteracts the bending forces and pressure forces affecting the springs upon the insertion of the linear connector into a hollow space of the spacing profiles and such that said spring is not tilted.

10. The connector according to claim 2, characterized in that each bar is arranged offset from one another with respect to the width of the springs.

11. The connector according to claim 10, characterized in that the bars are arranged offset with respect to the bottom plate.

12. Linear connector according to claim 1, characterized in that the bar substantially fills the free space between the springs.

13. The connector according to claim 1, characterized in that each leg is provided with at least two ribs located symmetrically to a center axis of the body.

14. The connector according to claim 1, characterized in that the rib forms with the bottom plate of the body on an inner wall of a leg an isosceles triangle.

15. The connector according to claim 1, characterized in that the rib extends up to half the height of a leg.

16. The connector according to claim 1, characterized in that the rib comprises a rectangular triangle the hypothenuse thereof is concave configured and enclose with a leg a rectangular angle.

17. Linear connector according to claim 1, comprising at least two reinforcing ribs and characterized in that said reinforcing ribs are of the same dimension and are equally distributed over the length of the body.

18. The linear connector according to claim 1, characterized in that each leg of the body is supported by a single reinforcing rib on the bottom plate of the body, which rib extends essentially over the entire length of the body.

19. Linear connector according to claim 1, characterized in that the rib is provided with inclined or rounded front sides and back sides.

20. Linear connector according to claim 19, characterized in that the reinforcing rib is aerodynamically configured to diminish flow resistance of hydroscopic powder passing over said ribs.

21. The connector according to claim 1, characterized in that said bar extends parallel to the longitudinal axis of the body.

* * * * *

UNITED STATES PATENT AND TRADEMARK OFFICE

CERTIFICATE OF CORRECTION

PATENT NO. : 6,347,902 B1
DATED : February 19, 2002
INVENTOR(S) : Walter Loh

It is certified that error appears in the above-identified patent and that said Letters Patent is hereby corrected as shown below:

Column 1,
Line 21, move to next line, new paragraph "Known linear...polluting the same"

Column 2,
Line 30, replace "nbs" with -- ribs --

Signed and Sealed this

Seventeenth Day of September, 2002

*Attest:*

*Attesting Officer*

JAMES E. ROGAN
*Director of the United States Patent and Trademark Office*